US006817498B1

(12) United States Patent
Spratt

(10) Patent No.: US 6,817,498 B1
(45) Date of Patent: Nov. 16, 2004

(54) SKATE MOUNTED RECEPTACLE DEVICE

(76) Inventor: Darcy Spratt, 212 Rocky Ridge Bay NW, Calgary, Alberta (CA), T3G 4H9

( * ) Notice: Subject to any disclaimer, the term of this patent is extended or adjusted under 35 U.S.C. 154(b) by 41 days.

(21) Appl. No.: 10/252,932

(22) Filed: Sep. 23, 2002

(51) Int. Cl.[7] ..... A45F 5/00

(52) U.S. Cl. ..... 224/191; 224/222; 36/132; 36/136; 280/809

(58) Field of Search ..... 224/191, 219, 224/221, 222; 36/132, 136; 280/809

(56) References Cited

U.S. PATENT DOCUMENTS

| | | | | | |
|---|---|---|---|---|---|
| 776,767 | A | | 12/1904 | Waters | |
| 1,609,481 | A | * | 12/1926 | McCarthy et al. | 224/219 |
| 1,851,750 | A | * | 3/1932 | Cartuschka | 206/101 |
| 2,255,999 | A | * | 9/1941 | Kuehner | 63/19 |
| 2,662,677 | A | | 12/1953 | Perry | |
| 3,009,614 | A | * | 11/1961 | Humphner | 224/219 |
| 3,010,627 | A | * | 11/1961 | Hoover | 224/219 |
| 4,473,969 | A | * | 10/1984 | Wilson | 446/26 |
| 4,507,882 | A | | 4/1985 | Harrell | |
| 4,536,975 | A | | 8/1985 | Harrell | |
| 4,824,140 | A | * | 4/1989 | Rankin | 281/89 |
| 4,897,947 | A | | 2/1990 | Kass-Pious | |
| 5,094,016 | A | | 3/1992 | DiVito | |
| D329,201 | S | * | 9/1992 | Barat | D10/31 |
| 5,168,644 | A | * | 12/1992 | Ellis | 36/72 R |
| 5,183,292 | A | | 2/1993 | Ragin, III | |
| 5,209,000 | A | | 5/1993 | Rowland et al. | |
| 5,311,679 | A | | 5/1994 | Birch, Sr. | |
| 5,496,612 | A | | 3/1996 | Ransbottom | |
| 5,596,821 | A | | 1/1997 | Solo | |
| D382,691 | S | | 8/1997 | Fuller et al. | |
| 6,010,438 | A | | 1/2000 | Fitzgerald | |
| 6,092,313 | A | | 7/2000 | Dunlap et al. | |
| 6,530,509 | B1 | * | 3/2003 | Davis | 224/219 |

* cited by examiner

*Primary Examiner*—Stephen K. Cronin
(74) *Attorney, Agent, or Firm*—Sturm & Fix LLP

(57) ABSTRACT

A skate mounted receptacle device (10) including a receptacle member (20) provided with a curved bottom (22) having a pair of spaced mounting apertures (23) dimensioned to receive a short strap member (40) for attaching the receptacle member (20) to the laces (201) of a skate (200); and, further including an independent lid member (30) having a contoured top (31) provided with a mounting slot (38) dimensioned to encircle the receptacle member (20) and the circumference of the shoe portion (205) of the skate (200) to releasably secure the lid member (30) to the receptacle member (30).

7 Claims, 2 Drawing Sheets

SKATE MOUNTED RECEPTACLE DEVICE

BACKGROUND OF THE INVENTION

CROSS REFERENCE TO RELATED APPLICATIONS

Not applicable.

1. Field of the Invention

The present invention relates to the field of specialized receptacles in general and in particular to a skate mounted receptacle for carrying personal possessions.

2. Description of Related Art

As can be seen by reference to the following U.S. Pat. Nos. 4,536,975; 4,507,882; 5,094,016; 5,209,000; and, 4,897,947, the prior art is replete with myriad and diverse body worn special receptacles used to store a variety of different articles on a person's footwear.

While all of the aforementioned prior art constructions are more than adequate for the basic purpose and function for which they have been specifically designed, they are uniformly deficient with respect to their failure to provide a simple, efficient, and practical arrangement of storing personal articles such as credit cards, cash, driver's license, personal identification, car keys, etc., on a pair of ice skates or in-line skates during the use thereof.

As anyone who enjoys skating in general, and in-line skating in very hot weather, is all too well aware, the bathing suits are not designed for the storage or transport of personal items and/or cash or credit cards which are normally required during the pursuit of their skating sojourn.

As a consequence of the foregoing situation, there has existed a longstanding need among skaters for a new and improved specialized storage receptacle that can be mounted directly onto one of their skates for the secure transport of personal items while skating; and, the provision of such an arrangement is the stated objective of the present invention.

BRIEF SUMMARY OF THE INVENTION

Briefly stated, the skate mounted receptacle device that forms the basis of the present invention comprises in general a receptacle unit, a lid unit, a first securing unit for attaching the receptacle unit to the top of the user's skate and a second securing unit for attaching the lid unit to both the receptacle unit and to the user's skate.

As will be explained in greater detail further on in the specification, the receptacle unit includes a receptacle member having raised sidewalls and a curved bottom provided with a pair of mounting apertures dimensioned to receive the first securing unit for attaching the receptacle member to the laces of a skate.

In addition, the lid unit includes a lid member having a contoured top provided with an elongated mounting slot dimensioned to receive the second securing unit which includes an elongated strap member dimensioned to encircle the receptacle member and the circumference of the shoe portion of the skate to releasably secure the lid member to the receptacle member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
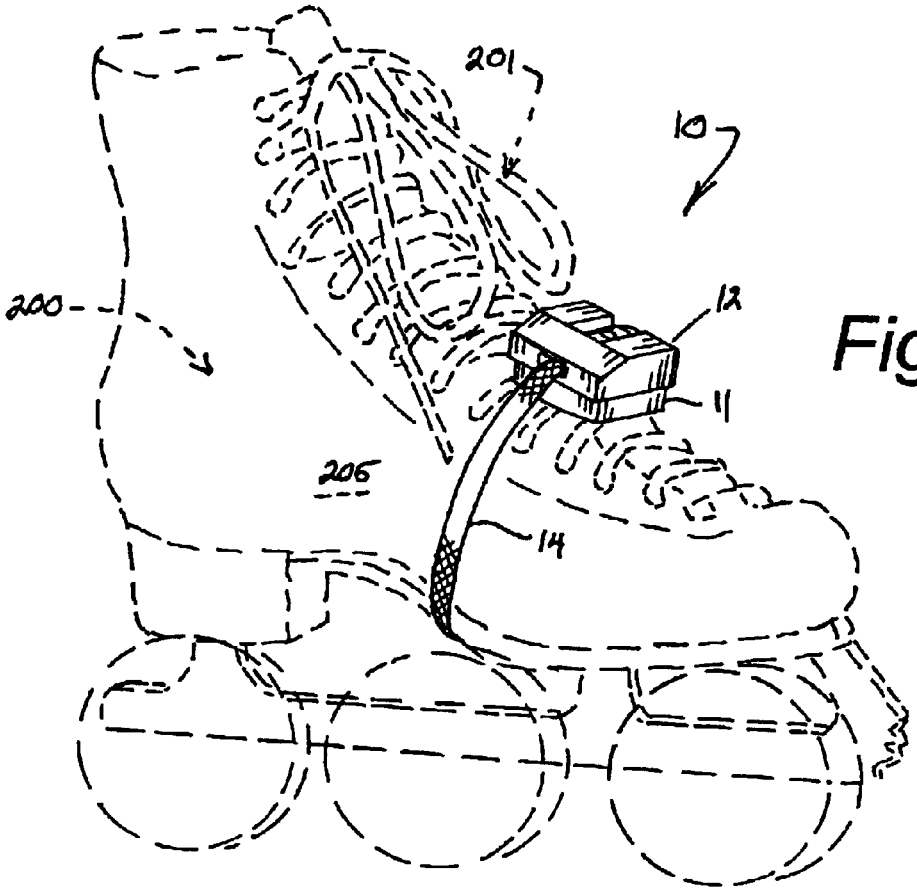
FIG. 1 is a perspective view of the receptacle device mounted on a skate.
Figure 2:
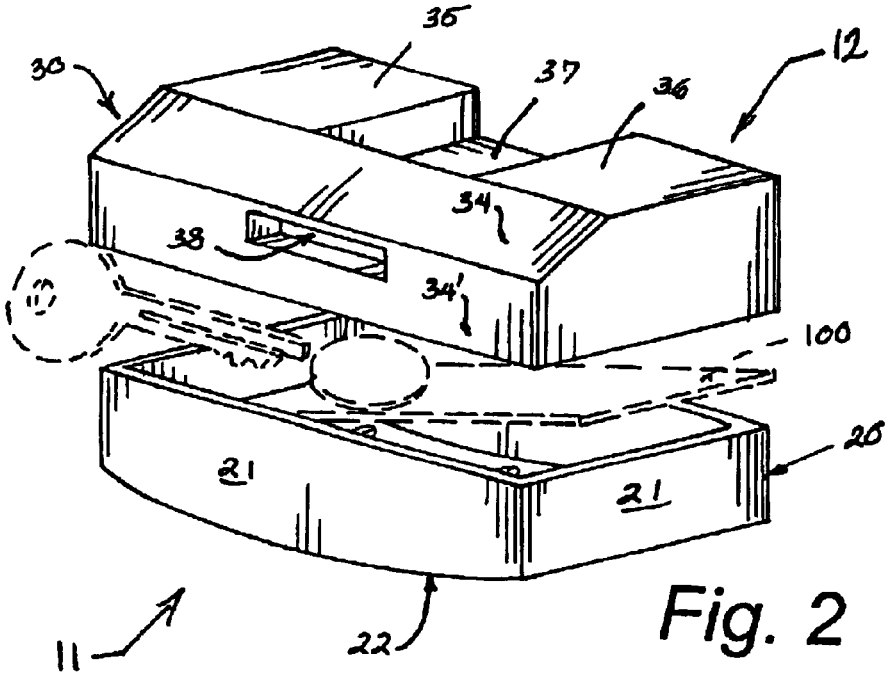
FIG. 2 is an exploded perspective view of the receptacle unit and the lid unit.
Figure 3:
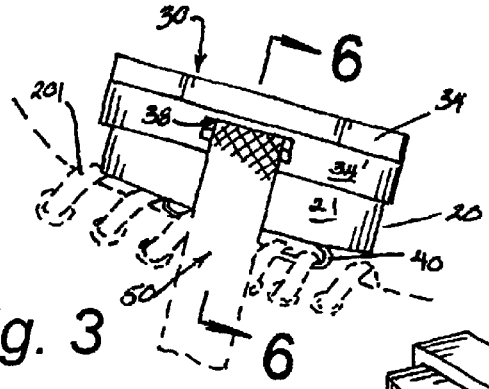
FIG. 3 is a side elevation view showing how the mounting units releasably secure the device to different portions of the skate.
Figure 4:
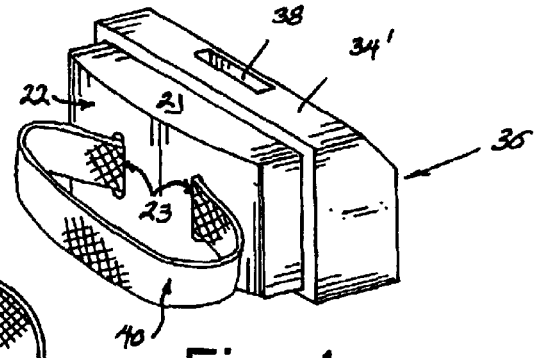
FIG. 4 is a rear perspective view showing the engagement between the first mounting unit and the receptacle unit.
Figure 5:
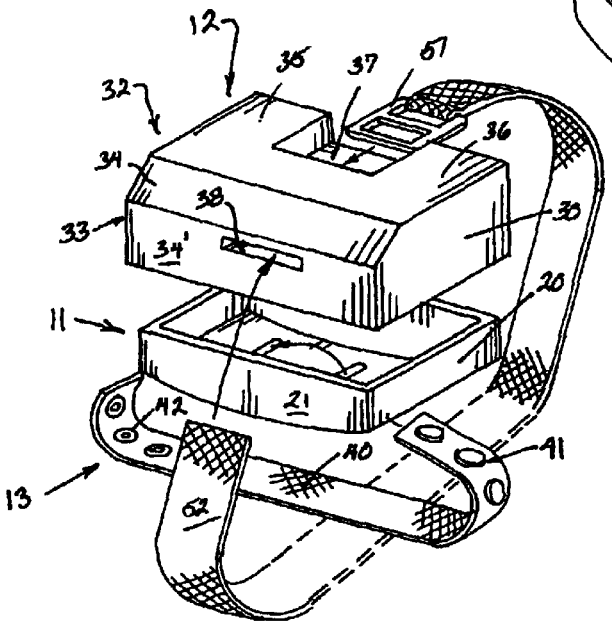
FIG. 5 is an exploded perspective view of the device.
Figure 6:
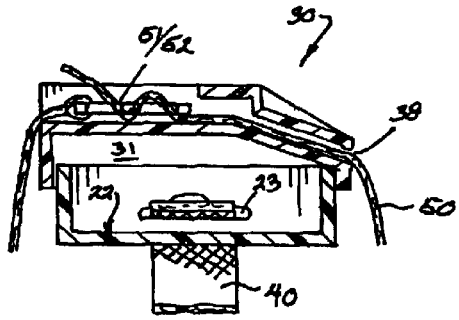
FIG. 6 is a cross-sectional view taken through line 6—6 of FIG. 3.

As can be seen by reference to the drawings, and in particular to FIG. 1, the skate mounted receptacle device that forms the basis of the present invention is designated generally by the reference number 10. The device 10 comprises in general a receptacle unit 11, a lid unit 12 and a pair of mounting units 13 and 14. These units will now be described in seriatim fashion.

As can be seen by reference to FIGS. 2 through 6, the receptacle unit 11 comprises a generally rectangular receptacle member 20 having raised sides 21 and a curved bottom 22 wherein, the curved bottom 22 is provided with a pair of discrete spaced mounting apertures 23 the purpose and function of which will be explained in greater detail further on in the specification.

It should also be noted at this juncture that in the preferred embodiment of the invention, the length and width of the interior of the receptacle member 20 is slightly greater than the length and width of a standard credit or debit card 100 and the minimum depth of the receptacle member 20 is at least ⅝".

As can also be seen in FIGS. 2 through 6, the lid unit 12 comprises a generally rectangular lid member 30 having a hollow interior 31 and a contoured top surface designated generally as 32 and including a front face 33 having an angled upper portion 34, and a pair of rearwardly extending side walls 35 36 that flank a downwardly angled intermediate portion 37 which is intersected by an upwardly angled mounting slot 38 which passes through the vertical lower portion 34' of the front face 33 of the lid member 30.

As shown in FIGS. 3 through 6, the first mounting unit 13 comprises a generally short thin strap member 40 which is dimensioned to pass through the pair of mounting apertures 23 in the curved bottom 22 of the receptacle member 20; wherein, in the preferred embodiment of the invention, the length of the first strap member 40 is approximately 4" and the opposite ends of the first strap member 40 are provided with cooperating snap elements 41 42 such that the first strap member 40 can be threaded through the laces 201 of a skate 200 to attach the receptacle member 20 to the top of the skate 200 in a generally permanent fashion.

In addition, as can best be seen by reference to FIGS. 1,3,5, and 6, the second securing unit 14 comprises an elongated strap member 50 dimensioned to pass through the mounting slot 38 in the lid member 30 and to encircle the receptacle member 20 and the circumference of the shoe portion 205 of the skate 200 when the lid member 30 is secured on top of the receptacle member 20 wherein, the opposite ends of the elongated strap 50 are provided with cooperating fasteners 51 52.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A receptacle device for attachment to a skate having a shoe portion provided with laces wherein, the device comprises a receptacle unit including a receptacle member having a bottom and raised sidewalls;

first means for connecting the receptacle member to the laces of the skate;

a lid unit including a lid member dimensioned to overlie the receptacle member; and, second means for releasably connecting the lid member to the receptacle members;

second means for releasably connecting the lid member to the receptacle member wherein, the lid member is further provided with at least one mounting slot dimensioned to receive said second means for releasably connecting the lid member to the receptacle member.

2. The device as in claim 1; wherein, the second means comprises an elongated strap member dimensioned to encircle the receptacle member and the shoe portion of the skate wherein, the elongated strap member has opposite ends provided with cooperating fasteners.

3. The device as in claim 1; wherein, the bottom of the receptacle member is provided with a pair of spaced mounting apertures.

4. The device as in claim 3; wherein, the spaced mounting apertures are dimensioned to receive the first means for connecting the receptacle member to the laces of the skate.

5. The device as in claim 1; wherein, the bottom of the receptacle member is curved.

6. The device as in claim 5; wherein, the bottom of the receptacle member is provided with a pair of spaced mounting apertures.

7. The device as in claim 6; wherein, the spaced mounting apertures are dimensioned to receive the first means for connecting the receptacle member to the laces of the skate.

* * * * *